US005085513A

United States Patent [19]

Ivarson

[11] Patent Number: 5,085,513

[45] Date of Patent: Feb. 4, 1992

[54] ARRANGEMENT FOR MIXING POWDER WITH LIQUID

[76] Inventor: Nemo Ivarson, Skönviksväsen 253, S-12242 Enskede, Sweden

[21] Appl. No.: 394,502

[22] Filed: Aug. 15, 1989

[30] Foreign Application Priority Data

Sep. 13, 1988 [SE] Sweden ..... 8803219

[51] Int. Cl.[5] ..... B01F 5/06; B01F 15/02

[52] U.S. Cl. ..... 366/155; 366/177; 366/193; 366/195; 366/196; 366/264; 366/305; 415/201; 415/214.1; 416/223 B; 425/382 R

[58] Field of Search ..... 366/105, 155, 184, 192, 366/193, 244, 263–265, 282, 241, 242, 194–196, 302, 327, 77, 178, 177, 305; 494/43, 48; 415/168.3, 201, 214.1, 912; 416/182, 223 B; 425/376.1, 331, 381.2, 200, 206, 378.2, DIG. 230, DIG. 293, 382 R

[56] References Cited

U.S. PATENT DOCUMENTS

| | | | |
|---|---|---|---|
| 1,485,235 | 2/1924 | Mauss | 494/48 |
| 1,768,928 | 7/1930 | Peters | 259/96 |
| 1,947,658 | 2/1934 | Pizzuto | 416/182 |
| 2,726,070 | 12/1955 | Tudor | 366/305 |
| 3,033,159 | 5/1962 | O'Brien . | |
| 3,043,570 | 7/1962 | Seiter . | |
| 3,163,402 | 12/1964 | Yamashita . | |
| 3,355,106 | 11/1967 | Graham | 366/155 X |
| 3,744,763 | 7/1973 | Schnoring et al. | 366/178 |
| 3,861,655 | 1/1975 | Wright | 366/305 |
| 3,998,433 | 12/1976 | Iwako | 366/178 |
| 4,096,587 | 6/1978 | Haller | 366/178 |
| 4,191,325 | 3/1980 | Stroucken et al. | 494/48 X |
| 4,284,233 | 8/1981 | Kulker | 494/48 X |
| 4,329,066 | 5/1982 | Ivarson | 366/155 X |
| 4,453,829 | 6/1984 | Althouse, III . | |
| 4,468,215 | 8/1984 | Wimmer | 494/48 |
| 4,690,834 | 9/1987 | Appelgren et al. . | |

FOREIGN PATENT DOCUMENTS

| | | | |
|---|---|---|---|
| 1757358 | 4/1971 | Fed. Rep. of Germany . | |
| 2079598 | 11/1971 | France . | |
| 2249713 | 5/1975 | France . | |
| 578209 | 6/1958 | Italy | 366/264 |
| 1038621 | 2/1986 | Japan | 366/150 |
| 0649451 | 3/1979 | U.S.S.R. | 366/155 |

*Primary Examiner*—Philip R. Coe
*Assistant Examiner*—C. Cooley
*Attorney, Agent, or Firm*—Young & Thompson

[57] ABSTRACT

An apparatus for mixing powder and liquid together continuously comprises a housing (1) which has a conical surface (16), and a rotor (7) which is journalled for rotation in the housing and which has a conical surface (9). The housing has provided therein a liquid inlet (20) through which liquid is delivered to a gap between the conical housing and rotor surfaces, and a powder inlet (12) through which powder is delivered to the upper surface (8a) of the rotor. As the rotor rotates, a liquid film is formed on the conical housing surface while, at the same time, powder is thrown onto the liquid film with the aid of rotor-carried guide vanes (10). The mixture is worked and pressed out through an outlet (30) by wing-like elements (11) carried by the rotor.

7 Claims, 1 Drawing Sheet

ARRANGEMENT FOR MIXING POWDER WITH LIQUID

The present invention relates to a method intended for mixing together liquid and powder substances to form an at least substantially homogenous mixture, and being of the kind in which the liquid is imparted a rotary movement such as to generate a liquid annulus, the powder being thrown radially outwards from a region radially within the annulus towards and into contact with the liquid mass and caught thereby. The invention also relates to an apparatus which can be used to carry out the method and which includes a housing, a rotor which is provided with guide means and which is journalled in the housing for rotation about a vertical rotational axis, means for delivering powder to the rotor, and means for delivering liquid to the housing and dispersing the liquid in a manner to form a liquid annulus therewithin, the guide means on said rotor being constructed so as to throw the powder radially outwards and into the liquid annulus as the rotor rotates.

A method of the aforesaid kind is known from, e.g., U.S. Pat. No. 4,329,066, according to which the liquid mass is whipped into a curtain of mist-like consistency by a rotor device. The powder is thrown into this mist curtain by the rotor and the liquid/powder mixture is driven radially outwards onto rotor-carried blades under the influence of the centrifugal force generated. The ready liquid/powder mixture is conveyed to an outlet, with the aid of the rotor blades. This method enables several, mutually different powdered materials to be mixed together with liquid while maintaining an accurate mixture ratio between powder and liquid during a continuous mixing process.

It has been found, however, that certain pulverulent materials which absorb liquid very rapidly, e.g. such materials as milk sugar and micro-cellulosic substances, cannot be mixed successfully with water with the aid of these known methods, owing to the tendency of such materials to adhere to the blades and subsequently block-up the mixing device used to carry out the method.

The object of the present invention is to provide a method of the kind set forth in the introduction which will allow even moist powder, which absorbs liquid very rapidly, to be mixed with a liquid without danger of the mixing device becoming blocked-up.

This object is achieved in accordance with the invention, by causing the liquid mass to rotate against a circular conical wall such as to form a liquid film on said wall causing the powder to be thrown radially outwards into contact with said liquid film from a region located radially inwards of the conical wall, and by permitting the mixture to flow axially in the direction in which the conical wall widens, under the influence of centrifugal force.

By permitting the powder to impinge on a liquid film carried by a conical surface in accordance with the invention, instead of impinging on liquid droplets freely suspended in a mist curtain, as in the case of the known method, it is possible to steer and control the mixing process more accurately than was previously the case, thereby enabling the problem of blockaging of the mixer to be eliminated completely.

An apparatus of the aforesaid kind capable of being used to carry out the method is characterized in that it comprises a rotor which has an inverted conical peripheral surface, and a housing having a conical surface which surrounds the outer surface of the rotor and which extends upwards beyond said peripheral surface of the rotor. The liquid supply device discharges into a gap between the conical surfaces of the housing and the rotor, the conical rotor surface being structured in a manner to entrain the liquid during its rotation, so as to form a rotating film of liquid on the conical wall surface of the housing. The guide devices on the rotor are configured to throw the powder into contact with the liquid film on the conical wall surface of the housing above the peripheral surface of the rotor. A mixture outlet is provided at a location above the conical housing surface.

An apparatus of this construction is not limited solely to producing mixtures of a dough-like consistency or mixtures in "slurry" form, but can be configured for direct production of such end products as granulates and extrusions, by means of simple manipulation or modification. This is made possible by the provision of an annulus which is fitted detachably to the apparatus, wherein the mixture is caused to flow axially into the space located above the conical wall under the influence of centrifugal force and under the influence of the slope of the conical wall, and is worked in said space by wing-like elements carried by the rotor and urged by said wing-like elements towards the annulus. By providing the mixing device with a multiple of annuli which each incorporate outlets of mutually different configuration, it is possible to switch between different end products, simply by exchanging one annulus for another.

The invention will now be described in more detail with reference to an exemplifying embodiment thereof illustrated in the accompanying drawings, in which FIG. 1 is a partially sectional side view of a mixing apparatus which can be used to carry out the inventive method;

Figure 1:
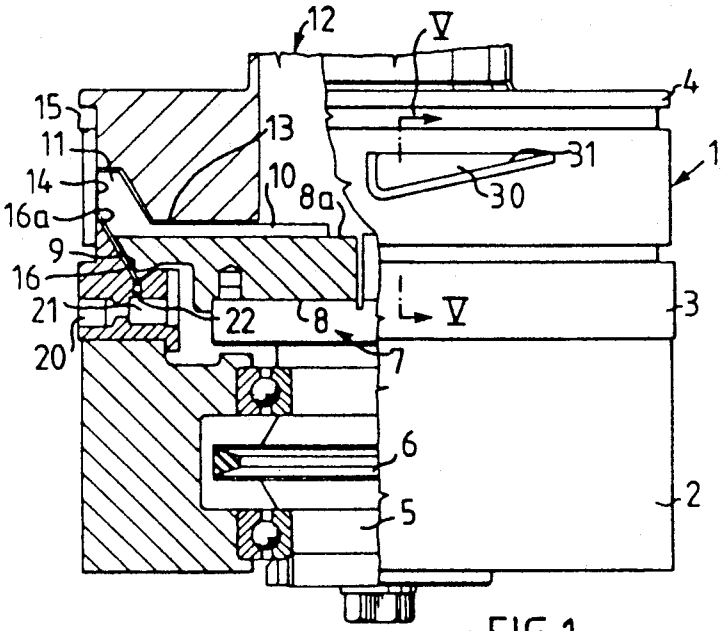
Figure 2:
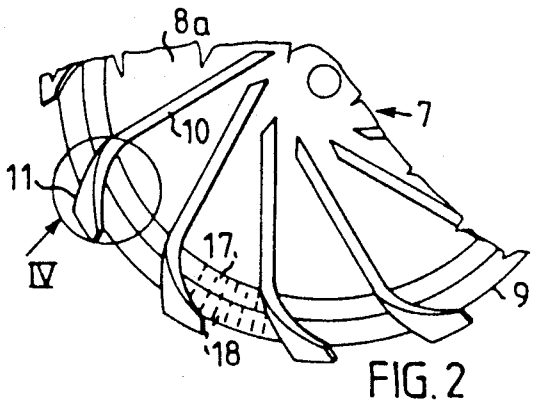
FIG. 2 is a plan view of part of the rotor.

The mixing apparatus illustrated in FIG. 1 includes a housing, designated generally 1, which comprises a base part 2, an intermediate part 3 and a cover 4, these housing parts being assembled together with the aid of screws, not shown. Rotatably mounted in the base part 2 is a shaft 5 having a drive plate 6. The shaft 5 carries a rotor, generally designated 7, which includes a disc 8 having a conical peripheral surface 9. The upper surface 8*a* of the disc 8 has provided thereon guide plates or vanes 10 which extend from a central region on the rotor, obliquely rearwards (seen in the direction of rotor rotation) and outwards, to the peripheral edge of the disc 8. The vanes 10 are oriented at right angles to the upper surface of the disc 8 and the radially outer extremities of the vanes are extended upwards to form wing-like elements 11 which are inclined rearwardly in relation to the actual vanes 10 themselves (as seen in the direction of rotation).

Figure 3:
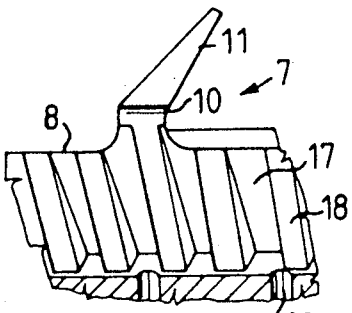
FIG. 3 is a plan view of part of the rotor.
Figure 4:
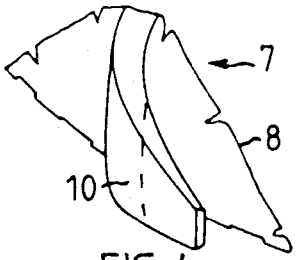
FIG. 4 is an enlarged view of the ringed area in FIG. 2.

The cover 4 has a centrally located powder inlet 12 and is configured so that only a narrow gap 13 is defined between the cover 4 and the upper defining surfaces of the vanes 10 and the wing-like elements 11. The space surrounding the rotor 7 is defined by a cylindrical wall 14 of an annulus 15 and a conical wall 16 on the intermediate housing part 3. The conical wall 16 has a part 16*a* which projects above the upper surface 8*a* of the rotor. The rotor surface 9 has formed therein grooves or channels 17 (see FIG. 3) which narrow in depth toward the upper surface of the rotor. The slope of the conical wall 16 coincides with the slope of the rotor surface parts 18 located between the grooves 17, those surface parts being disposed so that in practice a gap 19 (FIG. 5) in the order of 1/10 mm is formed therebetween.

The intermediate housing part 3 incorporates a liquid inlet 20 which discharges into an annular channel 21, from which circumferentially distributed bores 22 conduct liquid into the gap 19. The liquid conducted into the gap 19 is driven round by the rotor as it rotates, wherewith a particularly effective impeller action is obtained through the particular surface structure of the rotor, i.e. the grooves 17. The liquid is forced through the gap 19 under the action of centrifugal force and up onto the conical surface 16*a*, so as to form a thin rotating liquid film thereon. The powder is fed through the inlet 12 from a conveyor, not shown, and arrives at a central region of the disc 8, from where it is thrown outwardly by the vanes 10 and into contact with the liquid film on the conical surface 16*a*. Under the influence of the vertically acting component of the centrifugal force generated, resulting from the slope of the surface 16*a*, the liquid/powder mixture is driven upwards towards the cylindrical wall 14.

The mixture is driven upwards still further, by the action of the inclined wing-like elements 11, while at the same time being kneaded and "spread out" against the cylindrical wall on the annulus 15.

The annulus can be configured with mutually different outlets, dependent on the nature of the end product desired.

Figure 5:
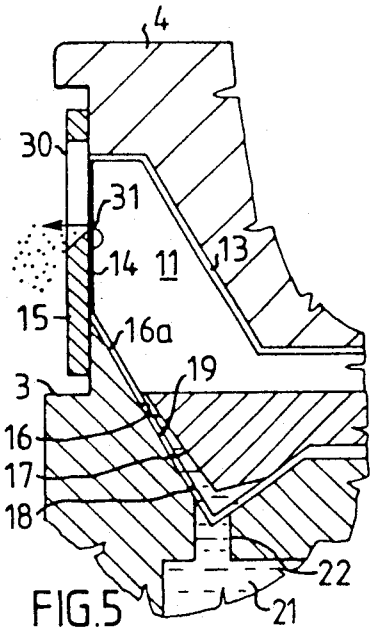
FIG. 5 is a sectional view in larger scale and taken on the line V—V in FIG. 1.
Figure 6:
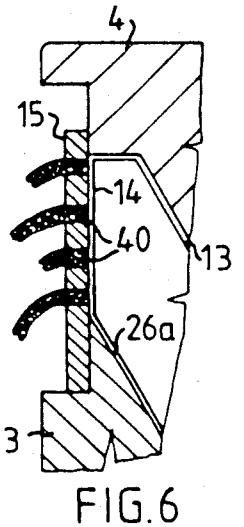
FIG. 6 is a view corresponding to FIG. 5 and showing a first modified embodiment.
Figure 7:
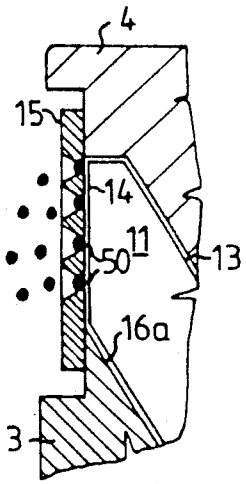
FIG. 7 is a view corresponding to FIG. 5 and showing a second modified embodiment.

In the case of the embodiments of FIGS. 1 and 5, the annulus is provided with a triangular slot 30, the lower edge surface of which has been ground down to a fine or sharp edge 31. When the mixture is driven round and pressed against the wall 14 by the wing-like elements 11, a wave of the mixture like the stern wave of about, is formed downstream of, or behind, the elements 11 and when this wave is broken up against the edge 31 there is formed a granulate comprised of relatively small but irregular particles. In the case of the FIG. 6 embodiment, the annulus 15 has an outlet 40 in the form of cylindrical perforations of relatively large diameter. The end product in this case is an extrusion. Finally, FIG. 7 illustrates an embodiment in which the outlet 40 of the annulus 15 has the form of conical perforations 50, which produce a granulate in which the granules are larger and of more regular shape than those obtained with the FIG. 5 embodiment. When the end product is desired in dough form or in slurry form, the annulus may be provided with a large cylindrical opening, optionally fitted with a nozzle.

The annulus is placed firmly on the intermediate housing part 3 and/or the cover 4 in a manner such, e.g. such as by friction, that the annulus can be changed readily, thereby enabling one and the same mixer to be used to produce mutually different end products, simply by effecting a change between annuli which incorporate mutually different outlet configurations. Furthermore, the annulus 15 can be made adjustable to mutually different height positions relative to the conical surface 16*a*, so as to enable the distance between the conical surface 16*a* and the outlet to be changed, thereby to vary the distance and the time through and during which the mixture is worked mechanically by the wing-like elements 11.

Although extremely good results have been obtained with a rotor 7 whose peripheral surface incorporates upwardly tapering grooves 17, an effectively working apparatus whose rotor peripheral surface has a different configuration to that described can be provided within the scope of this invention. The most essential feature in this respect is that the peripheral surface of the rotor is a friction inducing surface which will entrain the liquid so as to impart rotational motion thereto.

I claim:

1. In an apparatus for continuously mixing liquid and powder together to form an at least substantially homogenous mixture, comprising a housing, a rotor provided with guide means and journalled for rotation about a vertical axis in said housing, means for delivering powder to the rotor, and means for delivering liquid to the housing and for dispersing the liquid so as to form a liquid annulus therein, the guide means provided on said rotor being configured to throw the powder outwards and into the liquid annulus as the rotor rotates; the improvement wherein the rotor (7) has an inverted conical peripheral surface (9); the housing (1) has a stationary conical surface (16) which surrounds the peripheral surface of the rotor and which has an extension (16*a*) which extends upwardly beyond the peripheral surface of said rotor; said liquid delivery means (22) discharges into a gap (19) defined between the conical housing surface (16) and the conical rotor surface (9), said rotor surface (9) being configured to impart rotational movement to said liquid such as to form a rotating liquid film on the conical wall of said housing; the guide devices (10) on the rotor being configured to throw powder towards and in contact with the liquid film on said extension (16*a*) of the conical housing wall (16) above the conical peripheral surface of said rotor; and wherein a mixture outlet is provided above said conical surface of said housing.

2. Apparatus according to claim 1, characterized in that the rotor (7) has the form of a truncated cone with its base surface (8*a*) turned upwards; in that the conical wall (16) of the housing is of substantially complementary conicity; in that said conical housing wall (16) extends beyond said base surface and is contiguous with a cylindrical wall (14) which incorporates mixture outlets (30; 40; 50); and in that guide vanes (10) located on the upper surface of the rotor extend from a central region of the rotor outwardly towards the rotor periphery.

3. Apparatus according to claim 2, characterized in that mounted on the peripheral surface of the rotor (7) are wing-like elements (11) which extend upwardly and sweep beyond the outlet-incorporating wall (14) as the rotor rotates.

4. Apparatus according to claim 3, characterized in that the guide vanes (10) are substantially perpendicular to the upper surface (8*a*) of the rotor whereas the wing-like elements (11) are inclined rearwardly as seen in the direction of rotation.

5. Apparatus according to claim 2, characterized in that the wall (14) incorporating said outlet is formed by the radially inner surface of an annulus (15) which is axially displaceable in relation to the conical wall (16) of the housing (1) so as to vary the axial distance between said conical wall and said outlet (30; 40; 50).

6. Apparatus according to claim 2, characterized in that the wall (14) incorporating said outlet is formed by the radially inner surface of an annulus which is detachable from the remainder of the housing (1), so as to allow a change to be made between annuli having mutually different outlets (30; 40; 50).

7. Apparatus according to claim 1, characterized in that the conical rotor surface (9) has formed therein axially extending and circumferentially distributed grooves (17) whose respective depths decrease progressively from the lower surface of the conical rotor to the upper surface thereof.

* * * * *